US007722283B2

(12) United States Patent
Siu

(10) Patent No.: US 7,722,283 B2
(45) Date of Patent: May 25, 2010

(54) BOLLARD WITH CONNECTING MECHANISMS FOR CONNECTING RAILINGS

(75) Inventor: Kin Wai Michael Siu, Kowloon (HK)

(73) Assignee: The Hong Kong Polytechnic University, Hong Kong (CN)

( * ) Notice: Subject to any disclaimer, the term of this patent is extended or adjusted under 35 U.S.C. 154(b) by 685 days.

(21) Appl. No.: 11/537,478

(22) Filed: Sep. 29, 2006

(65) Prior Publication Data

US 2008/0075530 A1 Mar. 27, 2008

(30) Foreign Application Priority Data

Sep. 22, 2006 (HK) ..... 06110577.4

(51) Int. Cl.
*E01F 13/00* (2006.01)
*E01F 9/00* (2006.01)

(52) U.S. Cl. ..... 404/6; 404/9

(58) Field of Classification Search ..... 404/6, 404/9; 256/65.07, 65.03, 67, 65.08, 13.1, 256/65.01, 65.02, 65.13, DIG. 2; 52/832, 52/301, 844; 248/220.21, 220.22, 297.21, 248/155.4, 159; 403/3, 4
See application file for complete search history.

(56) References Cited

U.S. PATENT DOCUMENTS 1,144,031 A * 6/1915 Fuller ..... 248/201
1,587,676 A * 6/1926 Patterson ..... 211/1.3
2,677,519 A * 5/1954 Hobson ..... 248/125.3
2,722,970 A * 11/1955 Stechmann ..... 248/188.2
2,870,996 A * 1/1959 Helt ..... 256/22
3,104,428 A * 9/1963 Benham ..... 49/381
3,177,532 A * 4/1965 Domsic et al. ..... 49/381
3,380,429 A * 4/1968 Moinicken et al. ..... 116/63 R
3,614,068 A * 10/1971 Koehl ..... 256/19
4,807,837 A * 2/1989 Gawlik et al. ..... 248/125.8
5,022,617 A * 6/1991 Henderson ..... 248/125.8
5,342,138 A * 8/1994 Saito et al. ..... 403/189
5,365,695 A * 11/1994 Kjellberg ..... 49/49
5,481,828 A * 1/1996 Kentrotas ..... 49/35
5,645,271 A * 7/1997 Nunez ..... 256/67
5,664,905 A * 9/1997 Thompson et al. ..... 404/6
6,289,633 B1 * 9/2001 Lowe ..... 49/49
6,679,142 B1 * 1/2004 Lin ..... 81/437
6,827,336 B2 * 12/2004 Hwang ..... 256/24
7,077,598 B1 * 7/2006 Leonhardt et al. ..... 404/9
7,134,804 B2 * 11/2006 Skalka ..... 404/9
7,303,353 B2 * 12/2007 Carey ..... 404/6
7,374,363 B2 * 5/2008 Bousson et al. ..... 404/10
7,409,894 B1 * 8/2008 Valentine ..... 81/63.1
2006/0175594 A1 * 8/2006 Burkart et al. ..... 256/65.02

* cited by examiner

*Primary Examiner*—Thomas B Will
*Assistant Examiner*—Abigail A Risic
(74) *Attorney, Agent, or Firm*—Workman Nydegger

(57) ABSTRACT

A bollard with connecting mechanism for connecting railings, comprising: a bollard body which is provided with at least two receiving parts concave inwardly on each of opposite surfaces thereof; at least two connectors, each of which includes a base and an ear extending from the base and having a connecting hole thereon for connecting the railing; wherein the base is accommodated in the receiving part, and the ear is selectively accommodated in the receiving part or exposed out of the receiving part according to whether railings need to be connected.

6 Claims, 6 Drawing Sheets

BOLLARD WITH CONNECTING MECHANISMS FOR CONNECTING RAILINGS

FIELD OF THE INVENTION

The present invention relates to a bollard, more particularly, relates to a bollard with connecting mechanism for connecting railings.

BACKGROUND OF THE INVENTION

Bollards, particularly traffic bollards come in a variety of shapes and size. Some are permanently erected in the road, others are temporarily put out into the ground for example when road works in progress. To facilitate the safe and smooth movement of crowds, railings (also known as rails, gates, barriers or fences) are always required to be connected to bollards (also known as posts, poles or columns).

In order to connect the railing to the bollard, three types of mechanisms are generally adopted, i.e., a connecting mechanism of bollard suitable for particular used railings, a connecting mechanism of railing suitable for particular used bollards, or an additional connecting device used for connecting a bollard with a particular railing.

However, if use additional connecting device, various additional connecting devices have to be designed and produced for the various existing bollards and railings. This is discommodious and expensive. There are many known bollards provided with a connecting mechanism on the bollard body but such a bollard meets problems, for example, it is complicated to be produced or inconvenient for using. Above all, connecting mechanisms of the bollards generally include parts protruding from the bollards for connecting the railing to the bollard. When no railing is connected on it, such protruding parts always pose a safety hazard as well as inconvenience to the public.

There is therefore a need for a bollard with connecting mechanism which overcomes the above defects of the known additional connecting device and the known bollard with connecting mechanism.

SUMMARY OF THE INVENTION

An object of the present invention is to provide a bollard with a connecting mechanism for connecting railings, which has no protruding parts when no railing needs to be connected, in order to avoid a safety hazard to the public.

According to the invention, in one aspect, a bollard with a connecting mechanism for connecting railings comprises a bollard body which is provided with at least two receiving parts concave inwardly on each of opposite surfaces thereof; at least two connectors, each of which includes a base and an ear extending from the base and having a connecting hole thereon for connecting the railing; wherein the base is accommodated in the receiving part, and the ear is selectively accommodated in the receiving part or exposed out of the receiving part according to whether railings need to be connected.

In another aspect, the receiving part is formed by a concave portion of wall of the bollard body and has at least one inserting hole therein for inserting the ear.

In another aspect, the inserting hole of the receiving part on one of the opposite surfaces is at a height different from the inserting hole of the receiving part on the other of the opposite surfaces.

In another aspect, the bollard body is solid and the inserting hole of the receiving part on one of the opposite surfaces is through hole which communicates with the receiving part on the other of the opposite surfaces.

In another aspect, the bollard body is hollow and the inserting hole of the receiving part on one of the opposite surfaces is through hole which communicates with the cavity of the hollow bollard body.

In another aspect, a first fixing hole formed on the receiving part corresponds to a second fixing hole formed on the base so that a fixing member going through the first and second fixing holes fixes the base to the bollard body.

In another aspect, the cross-section of the bollard body is in symmetric form.

The bollard with connecting mechanism structured as the above is simple and easy to produce, and can be wildly applied to any kinds of bollards. Furthermore, no protruding part, which could pose a safety hazard to the public, is on the bollard with connecting mechanism when no railing is connected to it. Except for nuts and bolts, no additional parts are required for the connection of railing to the bollard. No part of the bollard ever has to be removed, regardless of whether railing is connected to the bollard or not. The railings can be connected to one or both sides according to the specific situation. Nuts and bolts are used for connecting the bollard body and the connectors. These nuts and bolts are not necessary to be removed and stored at additional place whether the railing (s) is connected to the connecting mechanism or not.

BRIEF DESCRIPTION OF DRAWINGS

The invention will be described for illustrative but not limitative purpose according to its preferred embodiments with particular reference to the enclosed drawings, wherein.

DETAILED DESCRIPTION OF THE PREFERRED EMBODIMENT

Figure 1A:
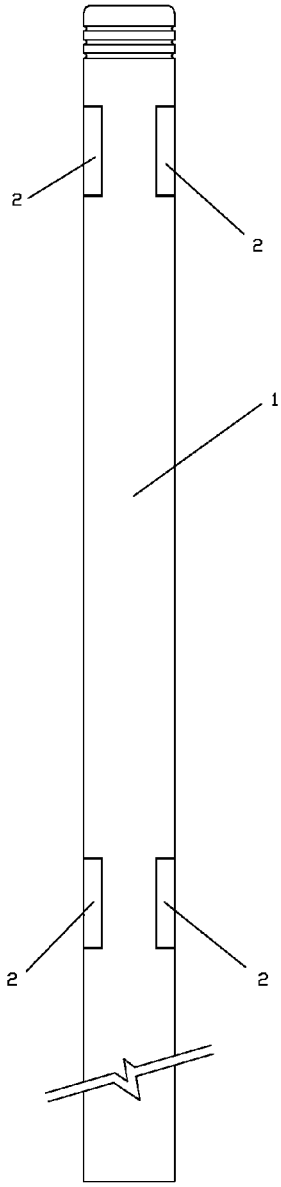
FIG. 1A shows a front view of the bollard with connecting mechanism according to a first embodiment of the invention in a first configuration.
Figure 1B:
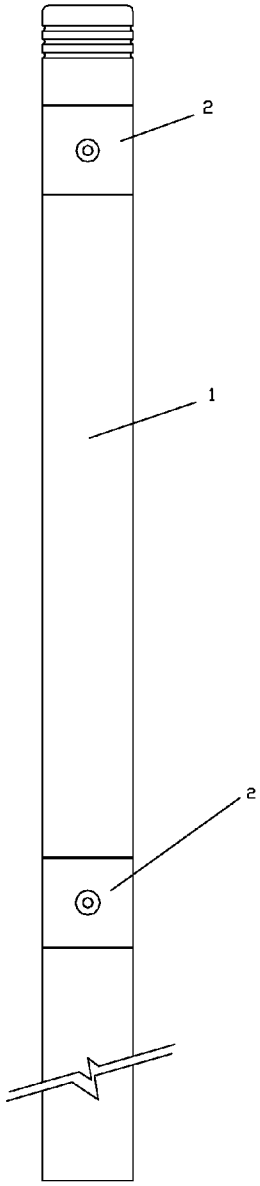
FIG. 1B shows a side view of the bollard in FIG. 1A.
Figure 1D:
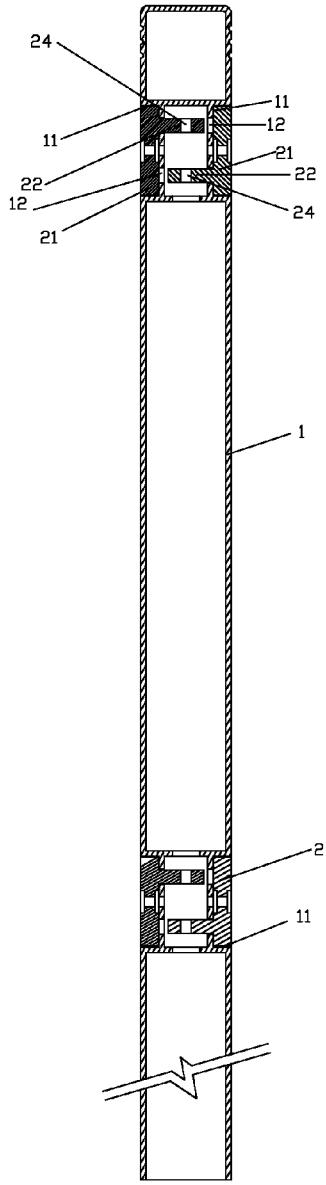
FIG. 1D shows a sectional view of the bollard in FIG. 1C taken along line A-A.
Figure 1C:
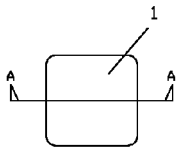
FIG. 1C shows a top view of the bollard in FIG. 1A.
Figure 2A:
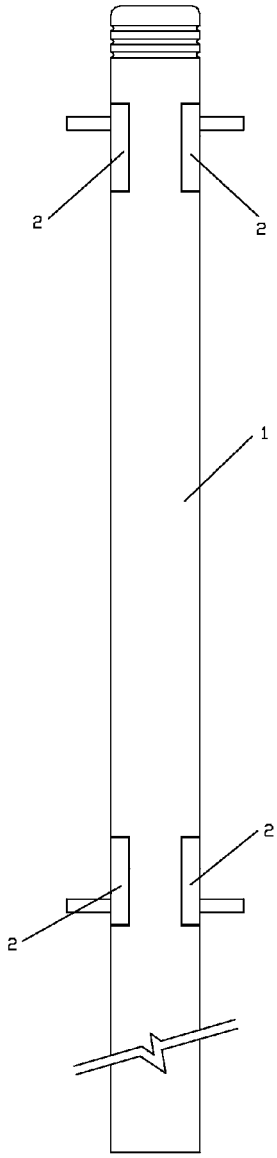
FIG. 2A shows a front view of the bollard with connecting mechanism according to the first embodiment of the invention in a second configuration.
Figure 2B:
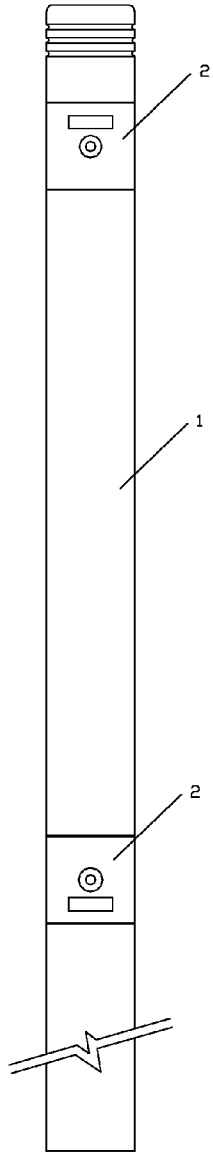
FIG. 2B shows a side view of the bollard in FIG. 2A.
Figure 2D:
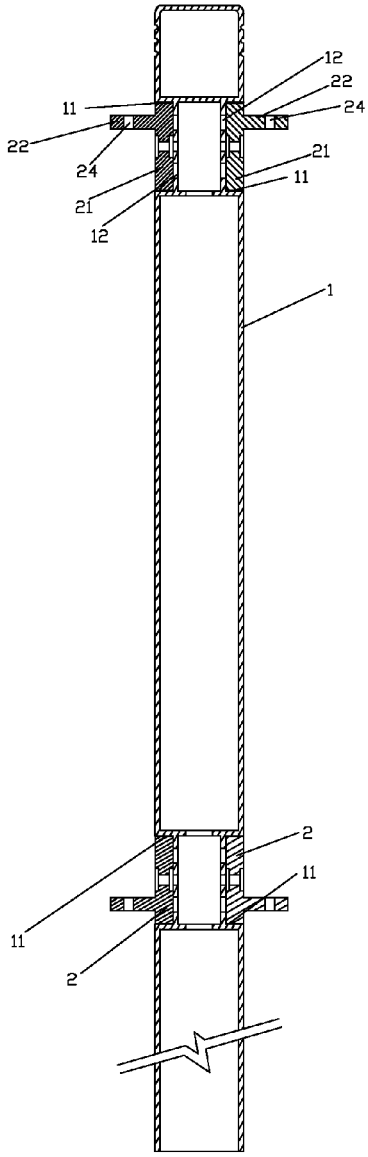
FIG. 2D shows a sectional view of the bollard in FIG. 2C taken along line A-A.
Figure 2C:
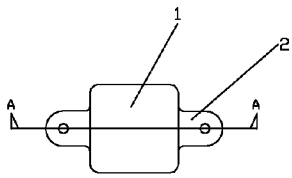
FIG. 2C shows a top view of the bollard in FIG. 2A.
Figure 3A:
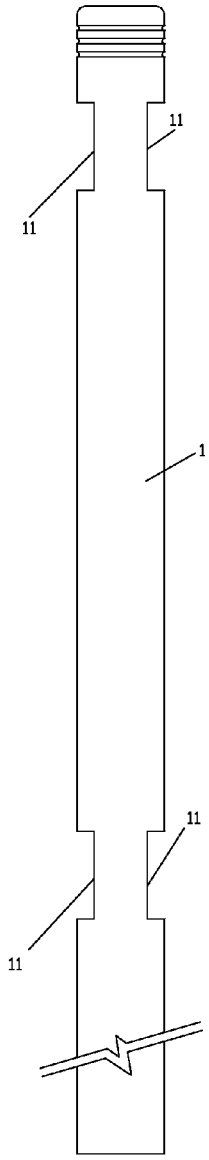
FIG. 3A shows a front view of the bollard body of the bollard with connecting mechanism according to the first embodiment of the invention, without any connector.
Figure 3B:
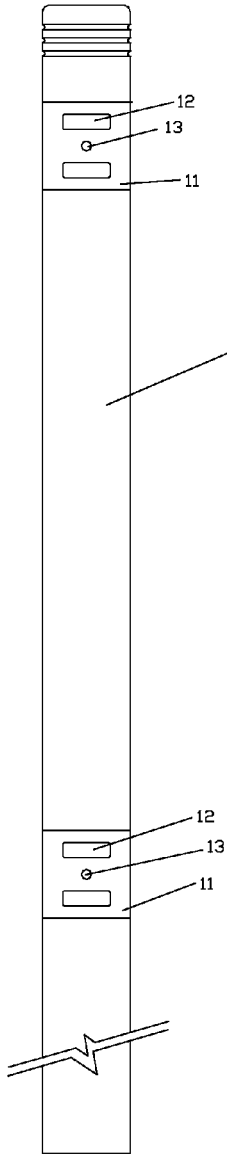
FIG. 3B shows a side view of the bollard body in FIG. 3A.
Figure 3D:
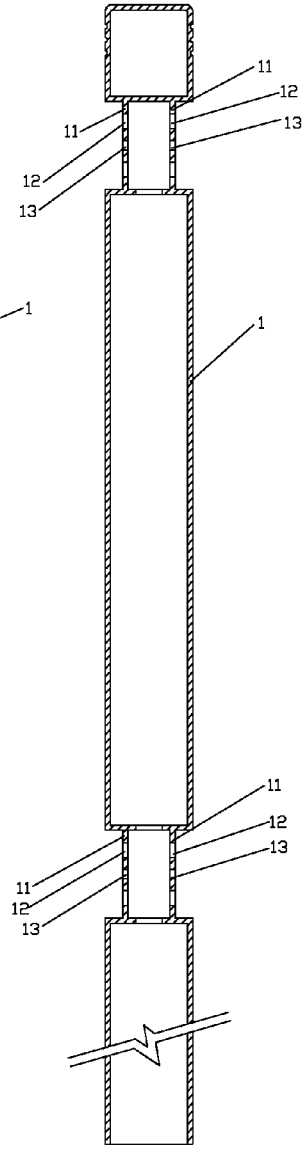
FIG. 3D shows a sectional view of the bollard body in FIG. 3C taken along line A-A.
Figure 3C:
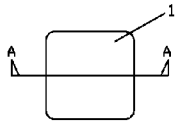
FIG. 3C shows a top view of the bollard body in FIG. 3A.
Figure 4E:
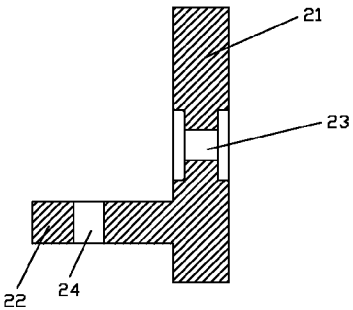
FIG. 4E shows a sectional view of the connector in FIG. 4D taken along line A-A.
Figure 4C:
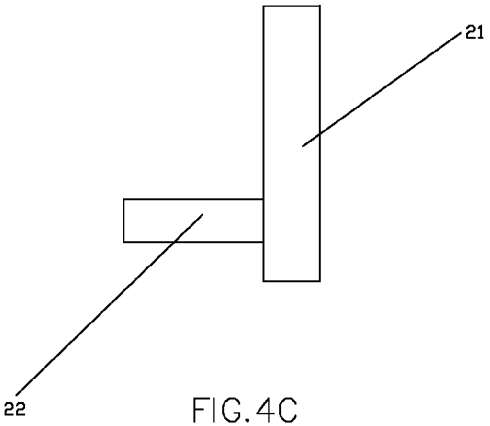
FIG. 4C shows a side view of the connector in FIG. 4A.
Figure 4D:
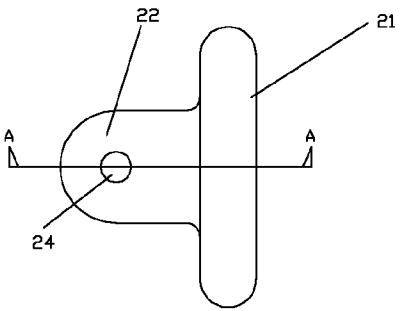
FIG. 4D shows a top view of the connector in FIG. 4A.
Figure 4A:
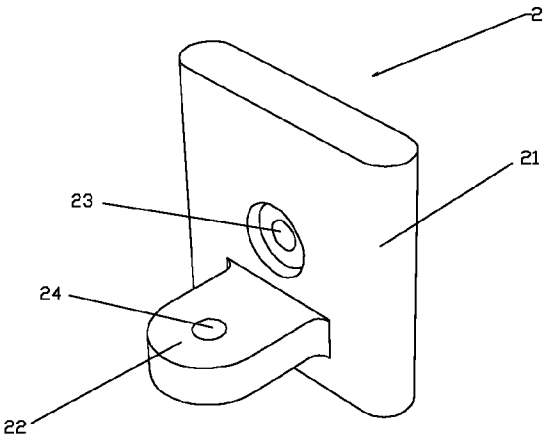
FIG. 4A shows a perspective view of the connector of the bollard with connecting mechanism according to the first embodiment of the invention.
Figure 4B:
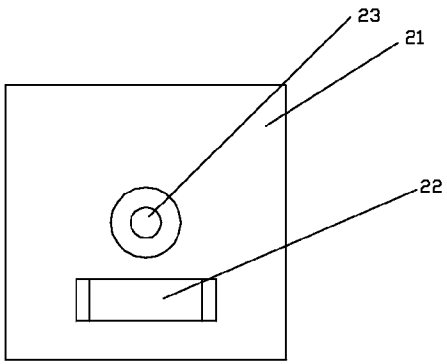
FIG. 4B shows a front view of the connector in FIG. 4A.

The first preferred embodiment with hollow bollard is described in detail with reference to the drawings.

Refer now to FIG. 1A to 1D and FIG. 2A to 1D. FIG. 1A to 1D show a first configuration of the bollard with connecting mechanism according to the first embodiment of the invention. FIG. 2A to 2D show a second configuration of the bollard with connecting mechanism according to the first embodiment of the invention.

As seen from FIG. 1A to 1D and FIG. 2A to 2D, a bollard with connecting mechanism according to the invention comprises a hollow bollard body 1 and two pairs of connectors 2. The bollard body 1 is provided with two pairs of receiving parts 11, each pair concave inwardly on each of opposite surfaces thereof. The two pairs of connectors 2 can be mounted into the receiving parts 11 in the two configurations.

Refer now to FIG. 3A to 3D. FIG. 3A to 3D show the bollard body 1 of the bollard with connecting mechanism according to the invention. As seen from FIG. 3A to 3D, the bollard body 1 is a hollow post with a square cross-section. Obviously the cross-section of the bollard body is not only bounded as square, and can be in any other symmetric form, e.g., circular, rectangular, hexagonal, octagonal, etc. Receiving parts 11 are formed on the bollard body 1 in pairs at the same height. The receiving part 11 is cubiform-shaped recess formed by a concave portion of wall of the hollow post and has two inserting holes 12. The inserting hole 12 is a through hole which communicates with the cavity of the hollow bollard body 1. A first fixing hole 13 is formed on the wall of the receiving part 11.

Refer now to the FIG. 4A to 4E. FIG. 4A to 4E show the connector 2 of the bollard according to the invention. The connector 2 is an integral part which has a base 21 and an ear 22. The base 21 is a flat and approximately cubiform board in a shape corresponding to the receiving part 11, such that it can be mounted into the receiving part 11 perfectly. The ear 22 is a flat and semi-elliptic board perpendicularly extending from one side of the base 21, in which a connecting hole 24 is formed for connecting the railing onto it. The width and thickness of the ear 22 correspond to the dimension of the inserting hole 12, and the length of the ear 22 is shorter than or equal to the width of the inner cavity of the hollow bollard body 1, such that the ear 22 can be inserted into the inner cavity through the inserting hole 12. A second fixing hole 23 is formed in the base 21 at a position corresponding to that of the first fixing hole 13 of the receiving part 11 such that the connector 2 can be fixed into the receiving parts 11 by nut and bolt. A recess is bored at each end of the fixing hole 23 such that it is better to house washer, nuts and/or bolt-head. Preferably, the first fixing hole 13 is formed on the centre of the receiving part 11 and the second fixing hole 23 is form on the centre of the base 21 such that the positions of holes 13 and 23 allow a higher flexibility for the base 21 to be accommodated in the receiving part 11. This flexibility allows the ears 22 of the connectors 2 on two opposite sides of the bollard 1 in different heights in order for a more flexible connection to the railings.

Then refer back to FIG. 1A to 1D. The first configuration is a state that no railing needs to be connected to the bollard. In the first configuration, the connectors 2 are completely mounted in the bollard body, with the ear 22 inserted through the inserting holes 12 and then into the inner cavities of the hollow bollard body 1 and the bases 21 accommodated in the receiving parts 11. Therefore, no any protruding parts remain when no railing needs to be connected to the bollard. It can be seen from FIG. 1D that the ears 22 of the connectors 2 in pair are mounted up and down such that the dimension of the bollard body 1 can be reduced.

Then refer back to FIG. 2A to 2D. The second configuration is a state ready for connecting the railing to the bollard. In the second configuration, the connectors 2 are rotated 180 degree and partly mounted in the bollard body 1, with the bases 21 accommodated in the receiving parts 11 and the ears 22 facing outward. It is preferable that a fixing mean such as a bolt passes through the fixing holes 13 and 23 to securely fix the connector 2 to the bollard body 1. Preferably, the connecting hole 24 is slot-shaped for providing flexibility to the connection between the railing and the bollard.

It is flexible to have a mixed configuration; that is, the first and second configurations can be existed at the same time. In other words, a connector 2 is partly mounted in the bollard body 1, with the base 21 accommodated in the receiving part 11 and the ear 22 facing outward. While at the same time another connector 2 at the opposite side is completely mounted in the bollard body 1, with the base 21 accommodated in the receiving part 11 and the ear 22 inserted in the inserting hole 12.

The second preferred embodiment with solid bollard is described in detail with reference to the drawings.

Figure 5A:
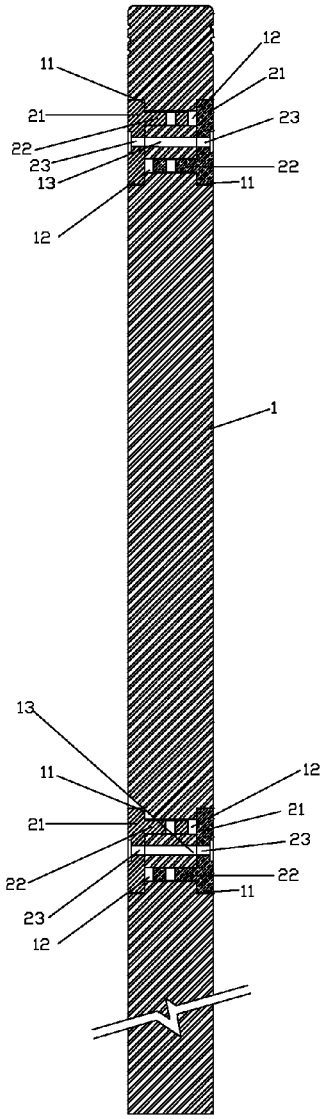
FIG. 5A shows a sectional view of the bollard with connecting mechanism according to a second embodiment of the invention in a first configuration.
Figure 5B:
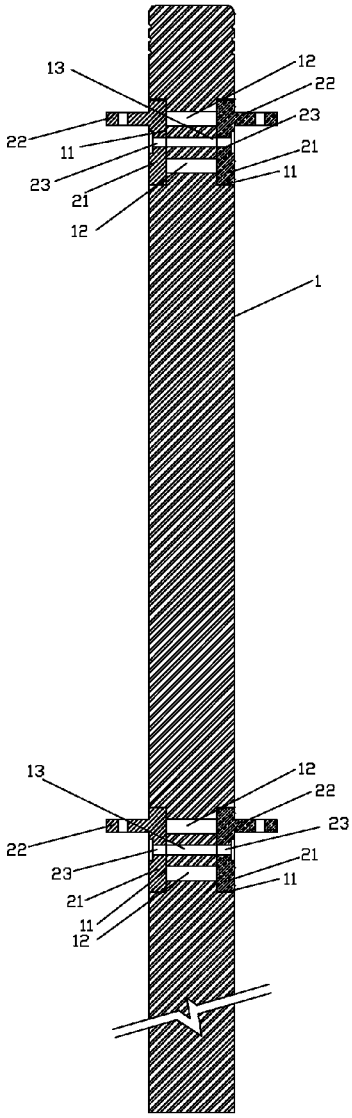
FIG. 5B shows a sectional view of the bollard with connecting mechanism according to the second embodiment of the invention in a second configuration.
Figure 5C:
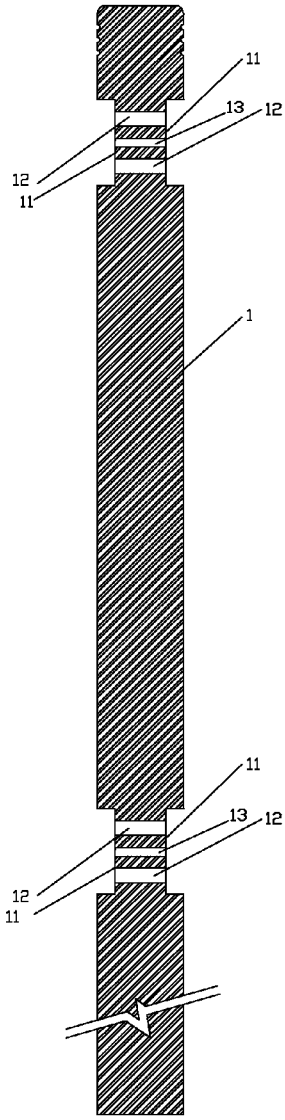
FIG. 5C shows a sectional view of the solid bollard body in FIG. 5A.

Please refer to FIG. 5A to 5C. In the second embodiment, the connector 2 is same as that in the first embodiment. The bollard body 1 is solid post with a square cross-section, in which two pairs of receiving parts 11 are formed. Obviously the cross-section of the bollard body 1 is not only bounded as square, and can be in any other symmetric form, e.g., circular, rectangular, hexagonal, octagonal, etc. The receiving part 11 is cubiform-shaped recess formed by a concave portion of wall of the post and has one inserting hole 12. The inserting hole 12 of the receiving part 11 on one of the opposite surfaces is formed through the solid bollard body 1 and communicates with the receiving part 12 on the other of the opposite surfaces. The first fixing hole 13 is also through hole communicating with both the pair of receiving parts 11 on the opposite sides.

The third preferred embodiment with solid bollard is described in detail with reference to the drawings.

Figure 6A:
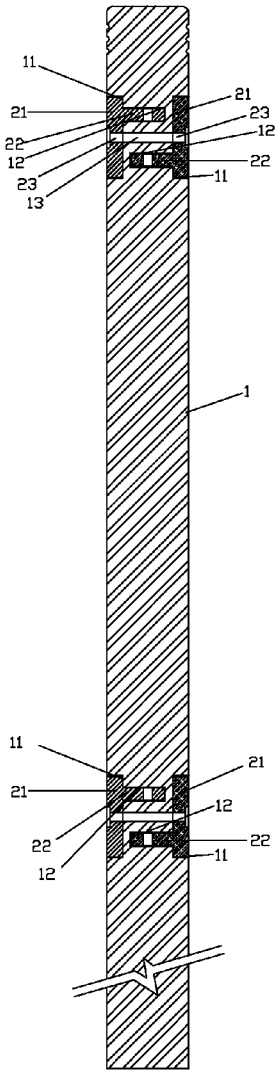
FIG. 6A shows a sectional view of the bollard with connecting mechanism according to a third embodiment of the invention in a first configuration.
Figure 6B:
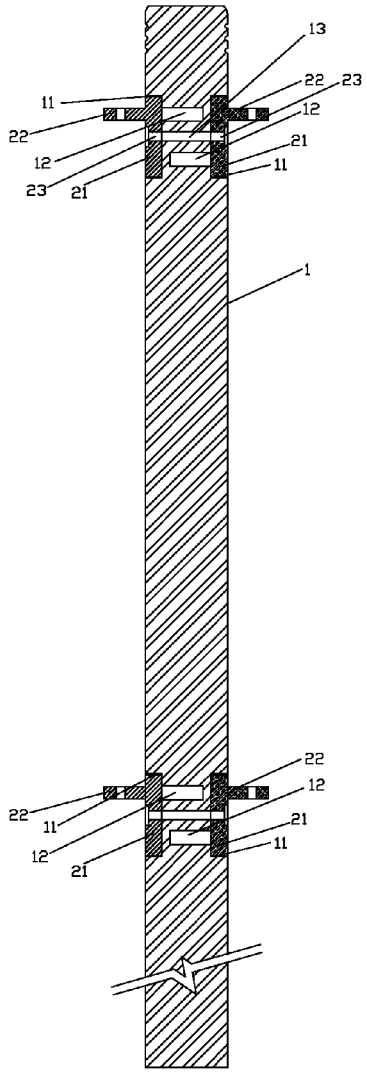
FIG. 6B shows a sectional view of the bollard with connecting mechanism according to the third embodiment of the invention in a second configuration.
Figure 6C:
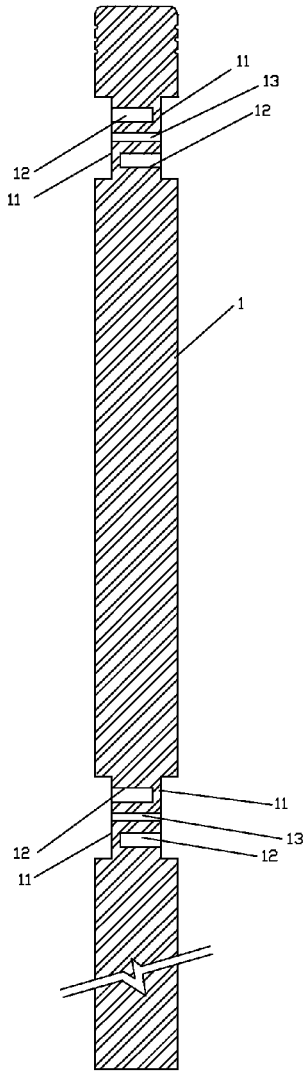
FIG. 6C shows a sectional view of the solid bollard body in FIG. 6A.

Please refer to FIG. 6A to 6C. In the third embodiment, the connector 2 is same as that in the first embodiment. The bollard body 1 is the solid post same as that in the second embodiment, in which two pairs of receiving parts 11 are formed. The receiving part 11 is cubiform-shaped recess formed by a concave portion of wall of the post and has one inserting holes 12. The inserting hole 12 is blind hole formed inside the solid bollard body 1. In this embodiment, the inserting hole 12 of the receiving part 11 on one of the opposite surfaces is at a height different from the inserting hole 12 of the receiving part 11 on the other of the opposite surfaces such that the dimension of the solid bollard body 1 can be reduced.

Obviously, the inserting hole 12 of the receiving part 11 on one of the opposite surfaces may be as high as the inserting hole 12 of the receiving part 11 on the other of the opposite surfaces.

What is claimed is:

1. A bollard with connecting mechanism for connecting railings, comprising:

a bollard body which is provided with at least one pair of receiving parts each being formed by an inwardly concave wall on opposite surfaces of said bollard body;

at least one pair of connectors, each of which includes a base and an ear perpendicularly extending from the base said ear having a connecting hole thereon for connecting a railing;

each receiving part being sized for accommodating said base of said connectors and having and has at least one inserting hole within the concave wall for inserting the ear of said connector;

wherein said base of each connector can either be received in the receiving part in a first position where the ear is inserted in said inserting hole or a second position where the ear is exposed outside of the receiving part so as to receive the railing.

2. The bollard with connecting mechanism for connecting railings according to claim 1, wherein the inserting hole of the receiving part on one of the opposite surfaces is at a height different from the inserting hole of the receiving part on the other of the opposite surfaces.

3. The bollard with connecting mechanism for connecting railings according to claim 1, wherein the bollard body is solid and the inserting hole of the receiving part on one of the opposite surfaces is a through hole which communicates with the receiving part on the other of the opposite surfaces.

4. The bollard with connecting mechanism for connecting railings according to claim 1, wherein the bollard body is hollow and the inserting hole of the receiving part on one of the opposite surfaces is a through hole which communicates with the cavity of the hollow bollard.

5. The bollard with connecting mechanism for connecting railings according to claim 1, wherein a first fixing hole formed on the receiving part corresponds to a second fixing hole formed on the base so that a fixing member going through the first and second fixing holes fixes the base to the bollard body.

6. The bollard with connecting mechanism for connecting railings according to claim 1, wherein the cross-section of the bollard body is in symmetric form.

* * * * *